US006261071B1

(12) United States Patent
Williams et al.

(10) Patent No.: US 6,261,071 B1
(45) Date of Patent: Jul. 17, 2001

(54) REDUCED HEIGHT SEALED COMPRESSOR AND INCORPORATION OF SUCTION TUBE

(75) Inventors: John R. Williams; Tracy L. Milliff, both of Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/410,593

(22) Filed: Oct. 1, 1999

(51) Int. Cl.[7] ..... F04B 39/02
(52) U.S. Cl. ..... 417/371; 417/366; 418/55.1
(58) Field of Search ..... 417/366, 368, 417/371, 902; 418/55.1

(56) References Cited

U.S. PATENT DOCUMENTS 3,601,507 * 8/1971 Harris ..... 417/354
4,744,737 * 5/1988 Yamamura et al. ..... 418/55
4,877,382 * 10/1989 Caillat et al. ..... 418/55
5,503,542 * 4/1996 Grassbaugh et al. ..... 418/55.1
6,042,346 * 3/2000 Doi ..... 417/371
6,171,084 * 1/2001 Wallis et al. ..... 418/55.1

* cited by examiner

*Primary Examiner*—Teresa Walberg
*Assistant Examiner*—Thor Campbell
(74) *Attorney, Agent, or Firm*—Carlson, Gaskey & Olds

(57) ABSTRACT

An improved compressor incorporates structure for facilitating the alignment of a suction tube with the motor stator windings. In one embodiment, the motor stator is provided with a protective coating such that the refrigerant entering the compressor housing through the suction tube does not damage the motor windings. In another feature, the chamber housing is bumped out in the location where the suction tube is mounted such that the distance between the radially inner end of the suction tube and the radially outer portion of the windings is increased. The above provides better protection for the motor windings in a sealed compressor wherein the suction tube is axially aligned with the motor windings.

28 Claims, 1 Drawing Sheet

REDUCED HEIGHT SEALED COMPRESSOR AND INCORPORATION OF SUCTION TUBE

BACKGROUND OF THE INVENTION

This invention relates to improvements to the motor stator windings and the suction tube structure for a reduced height sealed compressor.

Compressors for refrigerant are typically incorporated into a sealed housing. In a typical sealed compressor, a compressor pump unit is received at one end, and a motor drives a shaft to power the pump unit. The motor is sealed within the housing. A suction tube is mounted in the housing and communicates a refrigerant into a housing chamber which surrounds the motor. The suction pressure refrigerant entering the chamber cools the motor.

Typically, in the prior art, the entering refrigerant is at an axial location above the windings of the motor stator. Sometimes the suction gas enters the housing at a location axially aligned with the pump unit. These locations have resulted in undesirably long compressors. It is a goal of recent compressor development to reduce the height of the compressor.

One modern type compressor is a scroll compressor. In a scroll compressor, a first scroll member has a base and a generally spiral wrap extending from the base which interfits with a spiral wrap extending from the base of a second scroll member. The second scroll member is driven by the shaft to orbit relative to the first scroll member. The interfitting wraps define reduced volume compression chambers as the second scroll member orbits relative to the first.

Height reduction in a sealed compressor, and in particular a scroll compressor, presents challenges to the compressor designer. It would be desirable to have the suction tube aligned with the motor stator and in particular with the windings. However, with such an arrangement when the refrigerant is introduced through the suction tube, it is at a location which is closely adjacent to the stator windings. There may be debris, oil, or undesirable contaminants in the refrigerant which are introduced at force against the stator windings, and which may damage the stator windings. This can be undesirable. It would be desirable to increase the radial distance between the inner end of the suction tube and the radially outer location of the stator windings. However, there is little radial space in this area as the stator windings have a necessary outer diameter which has typically been relatively close to the inner diameter of the housing.

Thus, it would be desirable to incorporate changes into a sealed compressor which better facilitate the alignment of the suction tube with the stator windings.

SUMMARY OF THE INVENTION

In a disclosed embodiment of this invention the suction tube is placed within the length of the stator. Most preferably the suction tube is within the length of the stator windings. Most preferably, a protective coating is placed on the stator windings at least in a circumferential location aligned with a suction tube of a sealed compressor. The suction tube is axially aligned with the stator windings. However, the coating protects the windings against damage from contaminants. While the protective coating may be of any material, it is preferably a plastic. Further, it is most preferably a Mylar™ plastic.

In another feature of this invention, the suction tube is mounted in a location on the shell which is aligned with the axial location of the stator, but spaced radially away from the stator. The housing is preferably bumped radially outwardly adjacent the suction tube such that the inner end of the suction tube is spaced from the outer periphery of the stator by a greater distance. More preferably, the suction tube has a radially inner lip which is wrapped into the housing shell bump. In this way, the suction tube is mounted axially within the extent of the stator windings, and the housing can be made of a reduced height. Preferably, the stator windings are protected by both the coating, and by spacing the inner end of a suction tube away from the outer periphery of the windings due to the bumped out housing.

These and other features of the present invention can be best understood from the following specification and drawings, the following of which is a brief description.

DETAILED DESCRIPTION OF A PREFERRED EMBODIMENT

Figure 1:
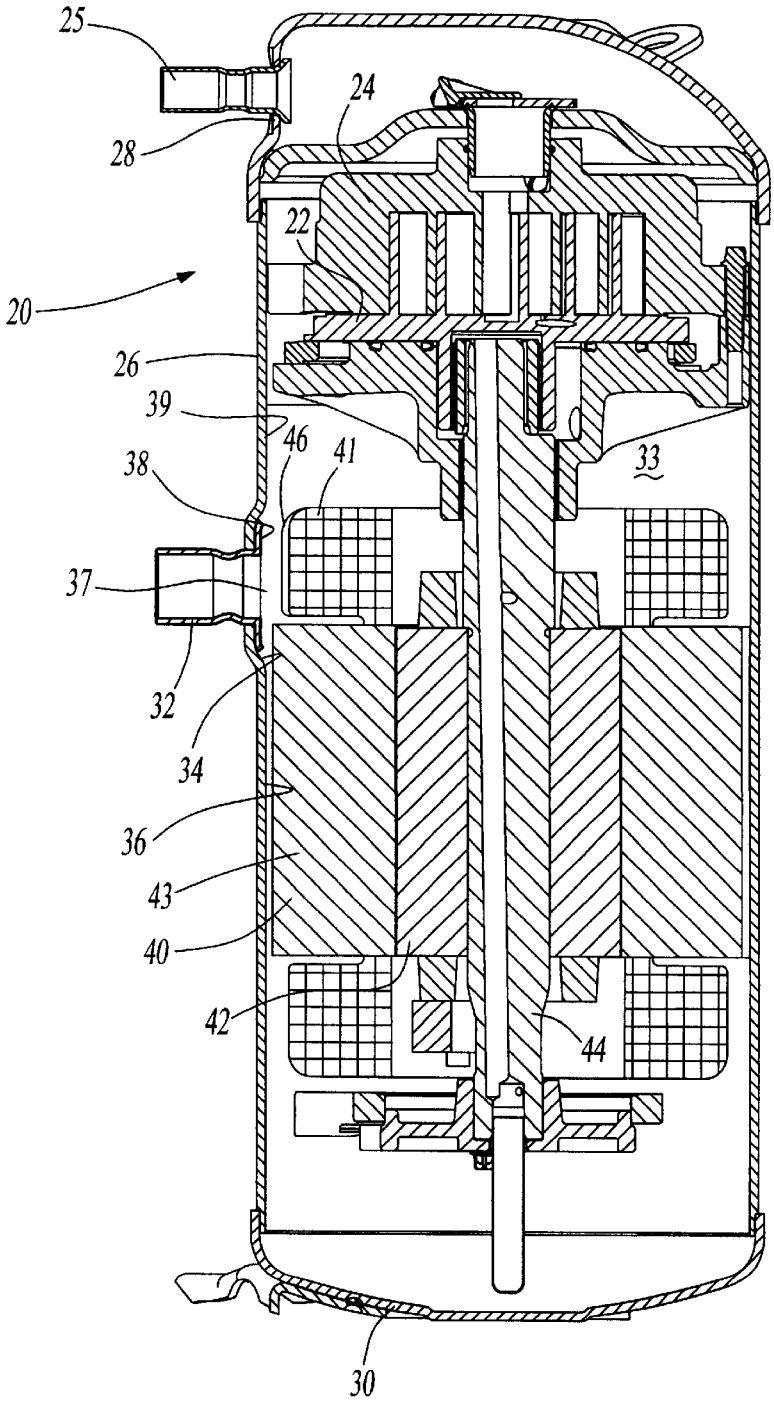
FIG. 1 is a cross-sectional view of a compressor incorporating the present invention.

FIG. 1 shows a scroll compressor 20 incorporating an orbiting scroll member 22 and a non-orbiting scroll member 24. A compressor discharge 25 receives compressed refrigerant from compression chambers defined between the orbiting and non-orbiting scrolls 22 and 24. A housing center shell 26 is secured to an upper shell 28 and a lower shell 30 to define a sealed compressor housing. A suction tube 32 extends through the center shell 36 to supply refrigerant into a chamber 33. As can be seen, the center shell 26 has a bumped out inner wall 34 that receives an inner lip 38 of the suction tube 32. The radially innermost portion of the inner lip 38 is radially inward of the nominal inner surface 39 of the center shell 26. Thus, the inner end 38 is spaced at 37 from a motor winding 41, as will be explained below. A motor 40 incorporates the winding 41 and a rotor 42. The winding 41 is associated with a stator 43. The rotor 42 is fixed to rotate with a shaft 44 which in turn drives the orbiting scroll 22, as known.

The present invention is utilized in conjunction with a compressor wherein the suction tube 32 extends through the housing 26 at a location such that it is at least partially axially aligned with the motor stator and preferably with windings 41. The axial direction is defined along the axis rotation of the shaft 44. In such a compressor, the increase in the space 37 provided by bumping out the shell 34 provides important benefits in providing additional space for the flow of refrigerant into the chamber 33. Further, this increases the distance between tube 32 and windings 41 reducing the likelihood of damage to the windings 41. While the suction tube 32 is shown aligned with windings 41 it may be beneficial in some applications to align the suction tube with the laminations.

Figure 2:
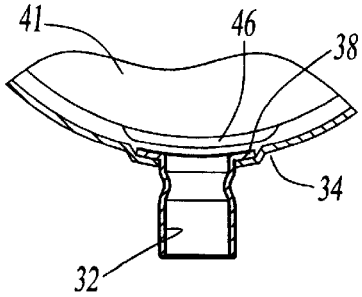
FIG. 2 is a cross-sectional view through a portion of the present invention.

As shown in FIG. 2, a protective coating 46 is mounted onto the windings 41. As can be appreciated from FIG. 1, the protective coating 46 extends preferably to both axial ends of the winding 41. As can be seen from FIG. 2, the protective coating 46 need not cover the entire circumference of the winding 41, but only need cover the windings 41 adjacent to the suction tube 32. The incorporation of the suction tube within the stator length, and more particularly at the winding level allows the motor cooling without any baffle to direct the suction refrigerant in a particular direction. Further, this placement of the suction tube allows more room for the girth weld tool to move into the sealed compressor at initial assembly. The bumped out shell also provides additional flow area.

The protective coating not only protects the windings from the refrigerant during operation, but further provides protection during assembly, shipment, handling and installation of the compressor. As an example, if a tool is inserted into the suction tube during installation, the protective coating will protect the winding. Moreover, when the suction tube is being welded to the suction refrigerant source, heat is applied along the suction tube. The coating may protect the winding from any damage due to this heat.

The protective coating may be of any suitable material which will protect the windings 41, but which will not affect the electrical characteristics of the motor 40. As an example, a plastic coating which is desirably of a tough material to provide resistance to damage from material which may impact against the coating 46 is most desired. One suitable plastic is Mylar™ sheet material. As known, Mylar™ is a polyester-based material. However, other plastics, and even other materials, may be utilized.

Although the coating is shown as a simple outer coating in the figures, preferably the coating is incorporated into the windings when they are initially formed. Technology is available wherein additional materials can be incorporated into the windings at selected circumferential areas during the formation of the windings. In the present invention, when the windings are initially wound, Mylar™ plastic will be preferably laced into the windings at least near the outer periphery of the windings and at the circumferential location shown in the figure. The figures are a simplified illustration of the existence of the coating, but in fact, the coating would preferably be formed as above. However, there may be applications and coatings which could be simply placed on the outer periphery such as illustrated.

While the invention has been disclosed in a scroll compressor, it should be understood the benefits of the invention would extend to other type sealed compressors.

A preferred embodiment of this invention has been disclosed; however, a worker of ordinary skill in this art would recognize that certain modifications would come within the scope of this invention. For that reason, the following claims should be studied to determine the true scope and content of this invention.

What is claimed is:

1. A sealed compressor comprising:

a compressor pump unit mounted at one end of a sealed housing, said sealed housing providing a fluid tight sealed chamber for receiving said compressor pump unit;

a motor mounted within said housing, said motor having a stator with stator windings spaced toward said compressor pump unit from said stator, and a rotor, said rotor driving a shaft about an axis for driving said compressor pump unit, said motor being received within a suction chamber;

a suction tube extending through said housing to provide refrigerant into said suction chamber, said suction tube being provided within said housing at a location along an axial direction defined by said shaft axis which is aligned with at least a portion of said stator windings; and said stator windings being provided with a protective coating at radially outer portions circumferentially aligned with said suction tube.

2. A sealed compressor as recited in claim 1, wherein said suction tube is received in a center shell, said center shell having a nominal inner diameter, and said suction tube being mounted in a portion of said center shell which extends radially outwardly from said nominal inner diameter.

3. A sealed compressor as recited in claim 2, wherein a bumped out portion receives said suction tube.

4. A sealed compressor as recited in claim 3, wherein said suction tube has an inner lip received in said bumped out portion.

5. A sealed compressor as recited in claim 4, wherein said suction tube is welded to said center shell.

6. A sealed compressor as recited in claim 4, wherein a radially innermost portion of said inner lip of said suction tube is radially outward of said nominal inner diameter.

7. A sealed compressor as recited in claim 1, wherein said protective coating extends only over a limited circumferential extent.

8. A sealed compressor as recited in claim 1, wherein said protective coating is formed of a plastic.

9. A sealed compressor as recited in claim 8, wherein said plastic is polyester-based.

10. A sealed compressor as recited in claim 1, wherein said compressor pump unit is a scroll compressor, said scroll compressor including a first scroll member and a second scroll member, each of said first and second scroll members having a base and a generally spiral wrap extending from the base, said first scroll member having its wrap interfitting with the wrap of said second scroll member, and said first scroll member being the portion of said compressor pump unit driven by said shaft to orbit relative to said second scroll member.

11. A sealed compressor as recited in claim 1, wherein said suction tube extending through an opening in said housing at said axial location.

12. A sealed compressor comprising:

a compressor pump unit mounted at one end of a sealed housing, said sealed housing providing a fluid tight sealed chamber for receiving said compressor pump unit, a motor mounted within said housing, said motor having a stator with stator windings, and a rotor, said rotor driving a shaft about an axis for driving said compressor pump unit, said motor being received within a suction chamber;

a suction tube extending through said housing to provide refrigerant into said suction chamber, said suction tube being provided within said housing at a location along an axial direction defined by said shaft axis which is aligned with at least a portion of said stator, and said suction tube being mounted into a center shell of said housing at a bumped out area such that said center shell has a nominal inner periphery and said suction tube is mounted in said center shell at a location which is formed radially outward of said nominal inner periphery.

13. A sealed compressor as recited in claim 12, wherein said suction tube has an inner lip received in said bumped out portion.

14. A sealed compressor as recited in claim 12, wherein said suction tube is welded to said center shell.

15. A sealed compressor as recited in claim 12, wherein a radially innermost portion of said inner lip of said suction tube is radially outward of said nominal inner diameter.

16. A sealed compressor as recited in claim 12, wherein said compressor pump unit is a scroll compressor, said scroll compressor including a first scroll member and a second scroll member, each of said first and second scroll members having a base and a generally spiral wrap extending from the base, said first scroll member having its wrap interfitting with the wrap of said second scroll member, and said first scroll member being the portion of said compressor pump unit driven by said shaft to orbit relative to said second scroll member.

17. A sealed compressor as recited in claim 12, wherein said suction tube is aligned with said stator windings.

18. A sealed compressor as recited in claim 12, wherein said suction tube extending through said center shell at said location.

19. A sealed compressor as recited in claim 12, wherein said stator winding which has at least a portion aligned with said suction tube is spaced towards the compressor pump unit from the remainder of said stator.

20. A sealed compressor comprising:

a compressor pump unit mounted at one end of a sealed housing, said sealed housing providing a fluid tight sealed chamber for receiving said compressor pump unit, a motor mounted within said housing, said motor having a stator with stator windings, and a rotor, said rotor driving a shaft about an axis for driving said compressor pump unit, said motor being received within a suction chamber;

a suction tube extending through said housing to provide refrigerant into said suction chamber, said suction tube being provided within said housing at a location along an axial direction defined by said shaft axis which is aligned with at least a portion of said stator windings;

said stator windings being provided with a protective coating at radially outer portions circumferentially aligned with said suction tube; and said suction tube being mounted in a center shell of said housing at a bumped out area such that said center shell has a nominal inner periphery and said suction tube is mounted in said center shell at a location which is formed radially outward of said nominal inner periphery.

21. A sealed compressor as recited in claim 20, wherein said protective coating is formed of a plastic.

22. A sealed compressor as recited in claim 21, wherein said plastic is polyester-based.

23. A sealed compressor as recited in claim 20, wherein a radially innermost portion of said inner lip of said suction tube is radially outward of said nominal inner diameter.

24. A sealed compressor as recited in claim 20, wherein said compressor pump unit is a scroll compressor, said scroll compressor including a first scroll member and a second scroll member, each of said first and second scroll members having a base and a generally spiral wrap extending from the base, said first scroll member having its wrap interfitting with the wrap of said second scroll member, and said first scroll member being the portion of said compressor pump unit driven by said shaft to orbit relative to said second scroll member.

25. A sealed compressor as recited in claim 20, wherein said suction tube bumped out area being at said location.

26. A sealed compressor as recited in claim 20, wherein said stator winding which has at least a portion aligned with said suction tube is spaced towards the compressor pump unit from the remainder of said stator.

27. A sealed compressor comprised in;

a scroll compressor pump unit mounted at one end of a sealed housing, said sealed housing providing a fluid tight sealed chamber for receiving said compressor pump unit;

a motor mounted within said housing, said motor having a stator with stator windings spaced toward said scroll compressor pump unit from the remainder of said stator, and a rotor for driving a shaft about an axis and driving said scroll compressor pump unit, said motor being received within a suction chamber;

a suction tube is to provide refrigerant into said suction chamber, said suction tube being provided within said housing at a location along an axial direction defined by said shaft axis which is aligned with at least a portion of said stator windings.

28. A sealed compressor as recited in claim 27, wherein said suction tube is mounted within an opening in said housing at said location.

* * * * *